United States Patent [19]

Ross

[11] 4,192,277

[45] Mar. 11, 1980

[54] AIR/FUEL RATIO METERING APPARATUS FOR USE WITH AN INTERNAL COMBUSTION ENGINE

[75] Inventor: Gray E. D. Ross, Tring, England

[73] Assignee: Zenith Carburetter Company Limited, Stanmore, England

[21] Appl. No.: 957,020

[22] Filed: Nov. 2, 1978

[51] Int. Cl.[2] ..... F02M 7/16; F02N 17/00

[52] U.S. Cl. ..... 123/179 G; 123/119 F; 261/39 D

[58] Field of Search ..... 261/50 A, 44 R, 63, 261/64 C; 123/179 G, 119 F, 124 A, 139 AW, 127

[56] References Cited

U.S. PATENT DOCUMENTS

| | | | |
|---|---|---|---|
| 3,859,974 | 1/1975 | Ross | 123/179 G |
| 3,934,571 | 1/1976 | Mennesson | 123/179 G |
| 3,967,610 | 7/1976 | Ross | 123/119 F |
| 4,069,802 | 1/1978 | Ross | 123/179 G |
| 4,114,584 | 9/1978 | Rogerson et al. | 123/179 G |
| 4,144,861 | 3/1979 | Yamashita et al. | 123/179 G |

*Primary Examiner*—Charles J. Myhre
*Assistant Examiner*—P. S. Lall
*Attorney, Agent, or Firm*—Stevens, Davis, Miller & Mosher

[57] ABSTRACT

A manifold depression responsive fuel pump has its fuel outlet connected to an automatic cold start air/fuel mixture supply device, and a movable stop, which limits movement of the pump diaphragm to enlarge the fuel chamber, has its position controlled by the engine temperature responsive thermostatic control mechanism of the cold start device. The pump diaphragm carries a shut-off valve opposite the pump fuel inlet. Fuel is pumped into the cold start device by the pump when the carburetter throttle valve is opened before the engine has warmed up to normal working temperature. The movable stop is moved towards the pump fuel inlet, as the engine warms up, and seats the shut-off valve in that fuel inlet when the engine has warmed up to its normal working temperature so that the pump does not function to pump fuel into the cold start device once the engine has warmed up to its normal working temperature.

9 Claims, 5 Drawing Figures

AIR/FUEL RATIO METERING APPARATUS FOR USE WITH AN INTERNAL COMBUSTION ENGINE

This invention relates to air/fuel ratio metering apparatus for use with an internal combustion engine, the apparatus being for mixing metered quantities of fuel with air drawn into the induction manifold of an internal combustion engine by the operation of the engine and for metering the quantities of the resultant air/fuel mixture so that the quantity of such air/fuel mixture drawn into the induction manifold by operation of the engine and the proportions of air and fuel in that mixture are varied with changes in the mode of operation of the engine in accordance with the changing requirements of the engine.

There are various kinds of carburetter which are operable to provide a metered quantity of an air/fuel mixture which matches the requirements of an internal combustion engine satisfactorily for most of theoperating modes of the engine once the engine has warmed up to its normal operating temperature. The so-called "fixed choke" or "conventional" carburetter is the kind of carburetter that is used most widely. Another form of carburetter that is in fairly general use is the so-called "air valve" carburetter which includes an air valve in the induction passage upstream of the driver-operable throttle valve, the air valve being responsive to the depression in that part of the induction passage between itself and the throttle valve and being operable automatically in response to any tendency for that depression to vary in order to modulate air flow into that part of the induction passage and thereby to maintain that depression substantially constant, that is to say between acceptable upper and lower limits.

Such carburetters are not best suited for meeting the special air/fuel requirements of a cold internal combustion engine whilst that engine is being cranked for starting and whilst it warms up to its normal operating temperature when running under its own power. Special cold start fuel/air mixture supply devices have been proposed for use in conjunction with such carburetters to meet those special air/fuel requirements and such cold start fuel/air mixture supply devices are designed so that the constitution of the air/fuel mixture supplied to the engine is changed firstly at the end of the engine cracking period, when the engine begins to run uner its own power, whereafter it can be changed progressively as the engine warms up to its normal operating temperature at which there is no further need for extra fuel or air to be supplied to the engine by a cold start fuel/air mixture supply device. Such cold start fuel/air mixture supply devices comprise an air supply passage which is connected to the induction passage of the carburetter downstream of the driver-operable throttle valve, an automatically-operable throttle valve in the air supply passage, the automatically-operable throttle valve being adapted to co-operate with an orifice which is formed within the air supply passage in order to throttle fluid flow through that orifice and being arranged to be urged to reduce the effective area of the orifice by suction generated in the inlet manifold of the engine by the engine when the engine is running under its own power, and a fuel passage which terminates in a fuel discharge nozzle which is formed in the air supply passage upstream of the orifice, the fuel passage including fuel metering means for metering flow of fuel drawn through the fuel passage from a source of liquid fuel by a depression which is established within the air supply passage upstream of the orifice when the engine is cranked for starting and when the engine is running under its own power whilst the orifice is open.

The depression in the induction manifold is high and the walls of the manifold are dry during idling conditions. That depression falls if the carburetter throttle valve is opened to accelerate the vehicle and such a fall in manifold depression is accompanied by wetting of the walls of the manifold with fuel.

The increase in the quantity of the air/fuel mixture required by the engine for acceleration and the increase in the proportion of fuel to air in that mixture can be achieved by automatic operation of the cold start device once steady state acceleration conditions are established but the amount of fuel drawn from the fuel passage of the cold start device is insufficient to compensate for the fuel that wets the walls of the manifold so that the higher, transient air and fuel requirements of the engine necessary when the engine is first accelerated from idling are not met by automatic operation of the cold start device alone.

An object of this invention is to provide an air/fuel induction system for an internal combustion engine which includes a carburetter and a fully automatic cold start fuel/air mixture supply device with means for meeting transient fuel requirements of the engine which cannot be met by automatic operation of the device alone when the engine is first accelerated from idling before the engine has warmed up to its normal working temperature at which there is no further need for extra air and fuel to be supplied to the engine by the device.

There is a problem which arises when an example of the kind of special cold start fuel/air mixture supply device which is referred to above as having been proposed is used in conjunction with a fixed choke carburetter which does not arise when such a cold start fuel/air mixture supply device is used in conjunction with an air valve carburetter. This problem follows from the well known characteristic of fixed choke carburetters by which, when the driver-operable throttle valve is opened fully to effect acceleration of the engine, the depression that is established between the driver-operable throttle valve and the throat of fixed dimensions that is formed in the induction passage upstream of the driver-operable throttle valve, and which acts to draw fuel into the induction passage for mixture with air flowing through the induction passage, falls to a negligible level so that the quantity of fuel drawn into the induction passage by that depression is insufficient to bring about the desired acceleration of the engine. It follows that, where a cold start fuel/air mixture supply device is used in conjunction with a fixed choke carburetter and the driver-operable throttle valve of that carburetter is opened fully to effect acceleration of the engine before the engine has warmed up to its normal operating temperature, the quantity of fuel drawn by operation of the engine from both the fixed choke carburetter and the cold start fuel/air mixture supply device during the transient conditions will be insufficient to effect the desired acceleration of the engine because the depression that acts to draw fuel into the air supply passage upstream of the orifice will diminish with the reduction in the depression in the induction passage.

Fixed choke carburetters are usually used in conjunction with mechanically-operable fuel pumps which are associated with the driver-operable throttle valve so that they are actuated mechanically by the driver's action of opening the driver operable throttle valve fully to effect acceleration of the engine. Such fuel pumps are arranged so that they pump fuel into the induction passage of the carburetter when so actuated. Another form of pump which has been proposed for this purpose includes a fuel chamber which has an outlet connected to the induction passage of the carburetter and a movable wall which is subjected to the depression in the induction passage and which is arranged to be moved to enlarge the volume of the fuel chamber and to draw liquid fuel into that fuel chamber by an increase in the depression in the induction passage and to be moved in the opposite direction, in response to a reduction in the depression in the induction passage that accompanies opening of the driver-operable throttle valve to effect acceleration of the engine, so that the volume of the fuel chamber is reduced and liquid fuel is displaced from that chamber through the outlet into the induction passage. The mechanically-operable pumps have been preferred to such depression responsive fuel pumps for this purpose because the mechanically-operable pumps can be arranged to react instantly to opening of the driver-operable throttle valve to supply to the induction passage the extra fuel that is required, whereas there is an undesirable time delay between opening of the driver-operable throttle valve to effect acceleration of the engine and the consequent supply of extra fuel to the induction passage by a pump which operates in response to the consequent reduction in the depression in that induction passage.

Another object of this invention is to provide compensation when transient conditions prevail for the reduction in the depression that is established in the air supply passage of a cold start fuel/air mixture supply device upstream of the orifice with which the automatically-operable throttle valve co-operates by operation of the engine before the engine reaches its normal operating temperature, that follows the reduction in the depression established in the induction passage by operation of the engine when the driver-operable throttle valve of a fixed choke caburetter is opened fully to effect acceleration of the engine.

Briefly the invention comprises the combination of a cold start fuel/air mixture supply device and a fuel pump for incorporation in an internal combustion engine air/fuel induction system which includes a carburetter as well. The fuel pump is adapted to pump liquid fuel into the air/fuel induction system when the carburetter throttle valve is opened so that the depression downstream of that throttle valve decreases. The performance of both the cold start device and the fuel pump is modulated by control means which are responsive to engine temperature so that the air/fuel mixture fed to the engine by the cold start device and the volume of fuel that is pumped into the air/fuel induction system by operation of the fuel pump is reduced as engine temperature increases.

An air/fuel induction system for an internal combustion engine in which this invention is embodied will be described now by way of example with reference to the accompanying drawings, of which:

Figure 1:
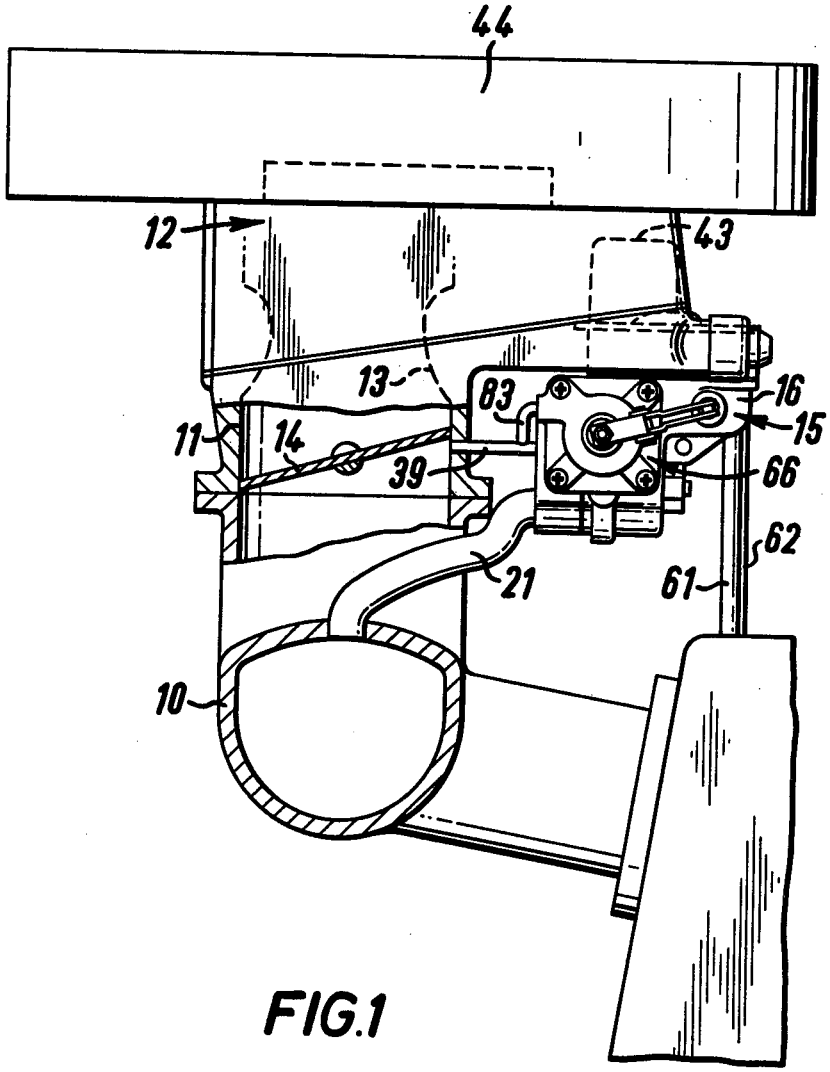
FIG. 1 is a partly sectioned elevation of an air/fuel induction system for an internal combustion engine, the system including a fixed choke carburetter and a cold start fuel/air mixture supply device.

FIG. 1 illustrates an internal combustion engine installation for a motor vehicle which includes an air/fuel induction system which comprises an engine inlet manifold 10 to which the induction passage 11 of a fixed choke carburetter 12 is connected. Fixed choke carburetters are well known and do not need to be described in detail in the specification, it being sufficient to note that, in the induction passage 11, they include a venturi throat 13 of fixed dimensions upstream of a driver-operable throttle valve 14.

Figure 2:
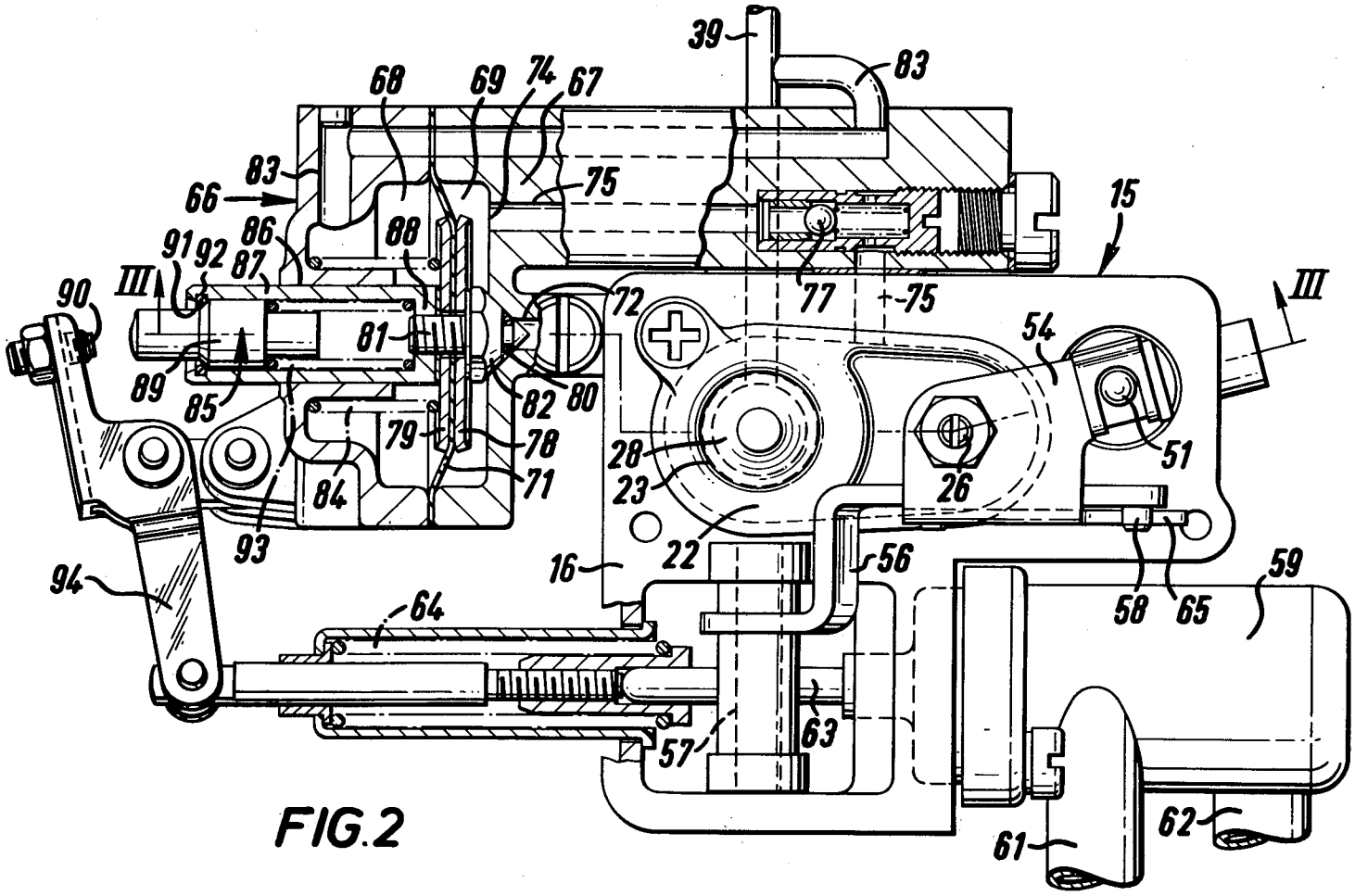
FIG. 2 is a partly sectioned plan view of the cold start fuel/air mixture supply device of the system shown in FIG. 1 with its cover removed.
Figure 3:
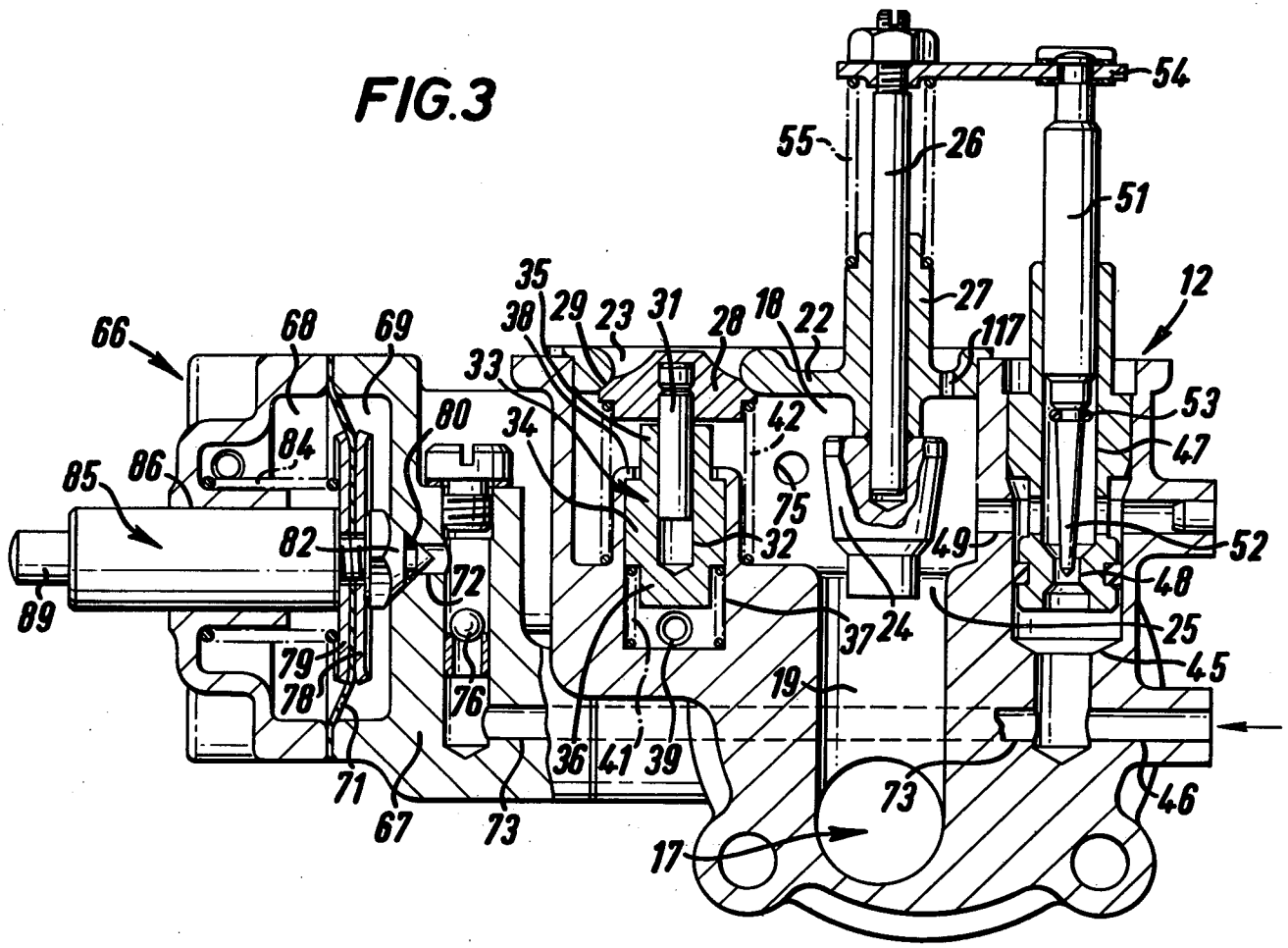
FIG. 3 is a section on the line III—III of FIG. 2.

The air/fuel induction system also includes a fully automatic cold start fuel/air mixture supply device 15 which comprises a body 16 which has a through passage 17 formed in it (see FIGS. 2 and 3). The through passage 17 comprises a chamber 18 and a downstream passage portion 19 which has a smaller cross-section than does the chamber 18. The downstream end of the downstream passage portion 19 is connected to the induction passage 11 of the fixed choke carburetter 12 downstream of the driver-operable throttle valve 14 via a pipe 21 (see FIG. 1).

FIGS. 2 and 3 show that the chamber 18 is closed at its upstream end by a closure plate 22 which has an aperture 23 and a hole 117 formed in it. The aperture 23 is displaced laterally with respect to the junction of the chamber 18 and the downstream passage portion 19.

A profiled plug valve 24 co-operates with the orifice 25 that is formed at the junction of the chamber 18 and the downstream passage portion 19 in order to control fluid flow from the chamber 18 to the downstream passage portion 19. The plug valve 24 is carried by a rod 26 which is guided for rectilinear movement along its axis by being engaged slidably within a tubular guide 27 which is integral with the closure plate 22.

A rectilinearly-movable air valve 28 co-operates with a valve seat 29 to close the aperture 23 in the closure plate 22. The air valve 28 has a coaxial cylindrical guide stem 31 which is engaged for sliding movement within a closed ended bore 32 which is formed coaxially in a plunger 33. The plunger 33 is stepped having a central portion 34 and smaller diameter end portions 35 and 36 at each end. The central plunger portion 34 is engaged for sliding movement within a blind bore 37 which is formed in the body 16 coaxially with the annular valve seat 29 and which has its mouth in the wall of the chamber 18. An inwardly directed radial flange 38 is formed by the body 16 at the mouth of the blind bore 37. The smaller diameter end portion 35 of the plunger 33 that is nearer to the air valve 28 projects through the aperture formed by the radial flange 38. The closed inner end portion of the blind bore 37 is connected to the induction passage 11 of the fixed choke carburetter 12 just downstream of the driver-operable throttle valve 14 by a short pipe 39. A coil spring 41 reacts against the closed end of the blind bore 37 and urges the larger diameter central plunger portion 34 towards the inwardly-directed radial flange 38 so that there is a space between the plunger 33 and the closed end of the blind bore 37. A coil spring 42 which acts directly upon the air valve 28 and urges it towards the valve seat 29 reacts against the body 16 around the mouth of the blind bore 37. The coil spring 42 functions as first yieldable biassing means which urge the air valve 28 towards its valve seat 29. The coil spring 41 also acts upon the air valve 28 to urge it towards its valve seat 29, but only indirectly through the plunger 33 and only when the plunger 33 abuts the air valve. Hence the coil spring 41 functions as second yieldable biassing means which urge the air valve 28 towards its valve seat 29 when the plunger 33 abuts the air valve 28.

The axes of the plunger 33, the guide stem 31 and the blind bore 37 are parallel to the axis of the plug valve rod 26 and are coincident with the axes of the air valve 28 and the annular valve seat 29. Normally the air valve 28 controls communication between the chamber 18 and an enclosure defined between the body 16 and a cup-shaped cover 43 of sheet material (see FIG. 1). The cover 43 has an inlet port which is connected to the outlet of the air cleaner 44 which is also connected to the upstream end of the induction passage 11 of the fixed choke carburetter 12.

Another through passage 45, which is formed within the body 16 has a stepped main bore portion which is substantially parallel with the axis of the plug valve support rod 26 and a laterally extending end bore portion 46 which is connected to the fuel chamber of the fixed choke carburetter 12. The end portion 47 of the stepped main bore remote from the laterally extending end bore portion 46 is in direct communication with the enclosure formed between the body 16 and the cup-shaped cover 43 and is separated from the remainder of the stepped main bore by the smallest diameter portion 48 of the stepped main bore. The end bore portion 47 communicates with the chamber 18 via a passage 49 in the body 16. The laterally extending end bore portion 46, the smallest diameter bore portion 48, the end bore portion 47 and the passage 49 by which the end bore portion 47 is connected to the chamber 18 together comprise a fuel passage and the smallest diameter bore portion 48 comprises a metering orifice for metering fuel flow through the fuel passage to the chamber 18.

A cylindrical member 51 carries a profiled fuel metering needle 52 and slides within the end portion 47 of the stepped through bore that is remote from the laterally extending end bore portion 46. The profiled needle 52 projects through the fuel metering orifice that is formed by the smallest diameter bore portion 48 and carries a sealing ring 53 at its largest diameter end which is the end that is attached to the cylindrical member 51. The end of the cylindrical member 51 remote from the profiled needle 52 is coupled to the plug valve support rod 26 by an arm 54 which is fixed at one end to the rod 26 and which extends laterally from it. The plug valve 24 and the fuel metering needle 52, which are coupled together and guided for rectilinear movement along parallel paths, are urged by a coil spring 55 into the respective positions in which the effective cross-sectional area of the orifices 25 and 48 with which they co-operate is at its greatest.

A beam 56 is mounted pivotally on a hinge pin 57 and carries a first peg 58 at one end, a second peg (not shown, being hidden by the arm 54 in FIG. 2) between the first peg 58 and the hinge pin 57 and a third peg (not shown, being hidden by the hinge pin 57 in FIG. 2) at its other end. A temperature sensitive capsule is housed within a water jacket 59 which is mounted on the body 16 and which is connected into the cooling water system of the engine by pipes 61 and 62. The capsule is filled with wax or other suitable substance having a high thermal expansion coefficient. The arrangement is such that, with increase in temperature, the wax or other substance expands and moves an actuator rod 63 along its length against the action of a coil spring 64. The actuator rod 63 carries an annular flange (not shown, being hidden by the hinge pin 57 in FIG. 2). The third peg extends between the flange and the capsule, the axes of the third peg and the rod 26 being mutually perpendicular. A torsion spring (not shown) reacts against the body 16 and acts on the beam 56 so that the third peg is held in contact with the flange and the first peg 58 is in contact with the outer limb 65 of a cranked arm at the same time, the cranked arm being fixed to the arm 54 that couples the plug valve support rod 26 and the fuel metering needle cylindrical support member 51 together.

The temperature sensitive capsule is sensitive to engine temperature, being responsive to engine water temperature, so that the angular position of the beam 56 is related to the temperature of the engine.

A fuel pump 66 is associated with the cold start device 15 and comprises a housing 67 which forms a cavity and which is mounted upon the body 16 of the cold start device 15. The cavity is divided interiorly into two chambers 68 and 69 by a rolling diaphragm 71 of flexible impervious material. The chamber 69 is a fuel chamber and has an inlet 72 which is connected by a conduit 73 with that part of the fuel passage of the cold start device 15 that extends between the smallest diameter bore portion 48 and the laterally-extending end bore portion 46. The fuel chamber 69 also has an outlet 74 which is connected by a conduit 75 with the chamber 18 that forms that part of the air supply passage of the cold start device 15 that extends between the air valve seat 29 and the orifice 25 that is formed at the junction of that chamber 18 and the downstream passage portion 19. The location of the fuel chamber outlet 74 is such that any air within the fuel chamber 69 can be expelled through the outlet 74 by fuel which enters the fuel chamber 69 through the inlet 72 so that the fuel chamber 69 can be filled with fuel. A one-way valve 76 in the conduit 73 prevents backflow of fuel from the fuel chamber inlet 72 to the fuel passage and another one-way valve 77 in the conduit 75 prevents flow of fuel and/or air from the air supply passage to the fuel chamber outlet 74.

The central portion of the rolling diaphragm is sandwiched between a pair of metal discs 78 and 79. The two discs 78 are secured together by a screw-threaded stem 81 which projects from a conical valve 82 so that that valve 82 is mounted at the centre of the rolling diaphragm 71, the valve 82 being located on that side of the diaphragm 71 that faces the fuel inlet 72 and the fuel outlet 74 so that the valve 82 is within the fuel chamber 69. The control valve 82 is adapted to be seated within the fuel chamber inlet 72, to close that inlet 72, by movement of the rolling diaphragm 71 towards that inlet 72. Hence the conical valve 82, which carries a sealing ring 80 within a circumferential groove in its conical surface, is a shut-off valve.

The other chamber 68 of the fuel pump 66 is connected by a conduit 83 to the pipe 39 that is connected to the induction passage 11 of the fixed choke carburetter 12 just downstream of the driver-operable throttle valve 14. A coil spring 84 in the other fuel pump chamber 68 urges the rolling diaphragm 71 towards the wall of the fuel chamber 69 in which the inlet 72 is formed and thus tends to minimise the volume of the fuel chamber 69.

A cylindrical telescopic member 85 is connected to the diaphragm 71 by the stem 81, extends through the other chamber 68 and is guided for rectilinear movement by being a good sliding fit within a bore 86 which is formed in that part of the fuel pump housing 67 that forms the wall of the chamber 68 that faces the rolling diaphragm 71. The telescopic member 85 comprises a tubular component 87, which has an inwardly directed annular flange 88 at its end that is nearer to the diaphragm 71, the central aperture of the flange 88 being tapped and receiving the stud 81 that is screwed therein, a plunger 89 which has an enlarged central portion which slides within the bore of the tubular component 87 and a smaller diameter end portion at each end, a circlip 91 which is retained within a circumferential groove 92 which is formed in the inner cylindrical surface of the tubular component 87 adjacent the end thereof remote from the flange 88, the circlip 91 serving to retain the central portion of the plunger 89 within the bore of the tubular component 87, and a coil spring 93 which reacts against the flange 88 and urges the central portion of the plunger 89 against the circlip 91 so that the remote smaller diameter end portion of the plunger 89 projects outwardly from the tubular component 87 through the circlip 91.

A lever 94 is hinged at one end to the end of the actuator rod 63 that is remote from the water jacket 59, is fulcrummed between its ends upon the fuel pump housing 67 and carries a grub screw 90 at its other end. The grub screw 90 serves as a stop which co-operates with the projecting smaller diameter end portion of the plunger 89 that is remote from the rolling diaphragm 71 in order to emit movement of the telescopic member 85 in the direction that moves the shut-off valve 82 away from the fuel inlet 72. Conveniently the actuator rod 63 is in three coaxial parts, a first part which projects from the wax capsule into abutment with a second part which is hinged to the lever 94 and a third part which is screwed onto the second part and which forms a bore into which the first part projects and a flange upon which the coil spring 64 is seated. Hence movement of the actuator rod 63 which follows a change in the temperature of the engine is transmitted by the lever 94 to the grub screw 90 so that the position of the grub screw 90 relative to the fuel pump housing 67 is dependent upon the temperature of the engine, the grub screw 90 moving towards the fuel chamber 69 as the temperature of the engine increases. The plunger 89 is pushed towards the fuel chamber 69 by the grub screw 90 if it contacts that grub screw 90 whilst the grub screw 90 is moved towards the fuel chamber 69 by movement of the actuator rod 63 which accompanies an increase in the temperature of the engine. The coil spring 93 is sufficiently stiff for it to transmit any such movement of the plunger 89 to the tubular component 87 as long as the tubular component 87 is free to follow such movement.

When the engine is cold, and not running, the temperature sensitive capsule allows the actuator rod 63 to be held by the respective coil spring 64 in a position in which its annular flange is nearest to the capsule. Thus, due to the interengagement of the third peg and the annular flange, the beam 56 is held against the action of the torsion spring in the position in which the first peg 58 is furthest from the body 16, the torsion spring being extended. The arm 54 that links the plug valve support rod 26 and the fuel metering needle cylindrical support member 51 is held in its position furthest from the body 16 by the respective coil spring 55 so that the outer limb 65 of the cranked arm is in contact with the first peg 58. Thus the plug valve 24 is spaced from the orifice 25 that is formed at the junction of the chamber 18 and the downstream portion 19 of the air supply passage. The second peg is spaced from the arm 54 that links the plug valve support rod 26 and the fuel metering needle cylindrical support member 51 when the outer limb 65 of the cranked arm is in contact with the first peg 58 and serves as a stop which limits movement of the plug valve 24 towards the orifice 25 by limiting movement of the arm 54 towards the body 16. The air valve 28 is seated upon the associated valve seat 29 by the action of the respective coil spring 42. The shoulder at the end of the larger diameter central portion 34 of the plunger 33 is held against the inwardly directed annular flange 38 by the action of the coil spring 41 that reacts against the end of the blind bore 37 and urges the plunger 33 away from that closed end, so that there is a clearance between the air valve 28 and the adjacent end of the plunger 33. The shut-off valve 82 is held seated in the fuel pump inlet 72 by the action upon the rolling diaphragm 71 of the coil spring 84 within the other fuel pump chamber 68. There is a clearance between the grub screw 90 and the projecting smaller diameter end portion of the plunger 89 with which it co-operates.

When the engine is cranked for starting, the plug valve member 24, the fuel metering needle 52, the air valve 28, the plunger 34 and the grub screw 90 remain substantially in the positions just described. Suction exerted by the engine causes air to be drawn through the hole 117 into the chamber 18 that is formed between the valve seat 29 and the orifice 25. Also fuel is drawn in metered quantities through the fuel passage. Such fuel is drawn through the fuel metering orifice 48 at a high rate because the profiled needle 52 is withdrawn and the effective area of the fuel metering orifice 48 is at its greatest. In addition, the rolling diaphragm 71 will be displaced against the action of its spring bias if the force exerted upon it by the depression that is established in the other chamber 68 exceeds that spring bias. Such movement of the rolling diaphragm 71 unseats the shut-off valve 82 to open communication between the fuel chamber 69 and the fuel passage upstream of the fuel metering orifice 48, enlarges the volume of the fuel chamber 69 and draws fuel into the fuel chamber 69 from the fuel passage upstream of the fuel metering orifice 48. Whilst the engine is being cranked for starting, the diaphragm 71 will not be moved sufficiently, if at all, for the projecting smaller diameter end portion of the plunger 89 to contact the grub screw 90 that is positioned at the end of its path of movement which is remote from the fuel chamber inlet 72 because the engine is cold.

When the cold engine begins to run under its own power, increased suction exerted by the engine unseats the air valve 28 from the valve seat 29 and also draws the plunger 33 towards the closed end of the blind bore 37 so that the displacement of the air valve 28 from its valve seat 29 can be maximised and is determined solely by the action of the coil spring 42 that acts directly upon the air valve 28 and the depression in the chamber 18 that is formed in the air supply passage between the valve seat 29 and the orifice 25 that is associated with the plug valve member 24. Hence the depression that is established in that chamber 18 is maintained at or below a maximum depression which is dependent upon that loading of the coil spring 42 that acts directly upon the air valve 28 and which is the depression that is required to unseat the air valve 28. The plug valve 24 is urged towards its associated orifice 25 in the air supply passage until the arm 54 that links its support rod 26 and the fuel metering needle cylindrical support member 51 abuts the second stop which prevents further movement of the plug valve 24 towards its associated orifice 25 and movement of the fuel metering needle 52 with it. The rolling diaphragm 71 is displaced further against its spring bias to further enlarge the volume of the fuel chamber 69 and draw more fuel into the fuel chamber 69. The rolling diaphragm 71 may be displaced sufficiently for the projecting smaller diameter end portion of the plunger 89 to abut the grub screw 90 when the depression established in the inlet manifold 10 of the engine is maximised, which occurs when the engine is idling.

As the temperature of the engine increases, the temperature sensitive capsule urges the actuator rod 63 against the action of the respective coil spring 64 thus allowing the beam 56 to be rotated by the action of the torsion spring in the direction which moves the first peg 58 and the second peg towards the body 16 of the cold start device 15. Assuming that idling conditions are maintained until the engine warms up to its normal operating temperature, such movement of the second peg allows following movement of the arm 54 that links the plug valve support rod 26 and the fuel metering needle cylindrical support member 51 due to the action of engine suction on the plug valve member 24, so that the plug valve 24 is moved to reduce the effective area of the associated orifice 25 in the air supply passage and thus to reduce the mass flow of air through the air supply passage, and the profiled needle 52 is moved with it to reduce the effective area of the fuel metering orifice 48. Such movement of the actuator rod 63 is transmitted by the lever 94 to the grub screw 90 so that, if the plunger 89 abuts the grub screw 90 the telescopic member 85 is moved towards the fuel chamber 69. Hence the amount by which the rolling diaphragm 71 can be deflected by the action of the depression in the other fuel pump chamber 68 to increase the volume of the fuel chamber 69 is reduced so that the maximum potential volume of the fuel chamber 69 is reduced also. Such movement of the plug valve member 24 and the grub screw 90 with movement of the actuator rod 63 continues until the temperature of the engine has increased to the normal working temperature whereupon the plug valve 24 reaches the end of its stroke remote from the closure plate 22 and effectively closes the associated orifice 25 in the fuel supply passage. At the same time the grub screw 90 engages the plunger 89 and acts through the telescopic member 85 and the rolling diaphragm 71 (as shown in FIG. 2) to seat the shut-off valve 82 within the inlet 72 of the fuel chamber 69 to close communication between the fuel passage and the fuel chamber 69. Hence the supply of fuel by the fuel pump 66 to the air supply passages ceases. The coil spring 93 in the telescopic member 85 allows further movement of the actuator rod 63 with further increases in the temperature of the engine once the shut-off valve 82 has seated so that the sealing ring 53 carried by the profiled needle 52 seats upon the shoulder formed between the smallest diameter bore portion 48 and the end bore portion 47 of the stepped through bore and closes the fuel metering orifice 48. The interconnection of the plug valve support rod 26, the arm 54 and fuel metering needle cylindrical support member 51 is arranged so that the sealing ring 63 seats to close the fuel metering orifice 48 just after the air supply passage is closed effectively by the plug valve 24.

The rate of flow of fuel through the fuel metering orifice 48 is dependent upon the effective area of the fuel metering orifice 48 and thus is altered in accordance with changes in engine temperature by the profiled needle 52 which is allowed to move with changes in engine temperature. Likewise the rate of flow of fuel/air mixture through the orifice 25 associated with the profiled plug valve 24 is altered in accordance with changes in engine temperature by the profiled plug valve 24 which is allowed to move with changes in engine temperature. Conveniently the profile of the plug valve 24 is selected so that the idling speed of the engine is maintained constant throughout the period required for the engine to warm up to its normal operating temperature. The quantity of fuel displaced from the fuel chamber 69 to the air supply passage by movement of the diaphragm 71 with movement of the plunger 89 as the engine warms up is negligible compared with the quantity of fuel that is drawn into the air supply passage from the fuel supply passage at the same time.

When the driver-operable throttle valve 14 is opened to increase the speed of the engine, the depression in the inlet manifold 10 is reduced with the result that the force on the plunger 34 due to engine suction is reduced also. If the depression in the inlet manifold 10 is reduced sufficiently, the loading of the coil spring 41 that acts upon the plunger 33 will exceed the force on the plunger 33 due to engine suction. Hence that coil spring 41 will extend and the plunger 33 will be urged towards the air valve 28. At least initially and when the engine is cold the depression in the chamber 18 of the air supply passage is sufficiently high for the air valve 28 to be spaced sufficiently from the valve seat 29 for the plunger 33 to strike the air valve 28 before it strikes the radially-inwardly directed annular flange 38 so that the plunger 33 will impart a thrust to the air valve 28. Such a thrust, together with the action of the coil spring 42 that acts directly upon the air valve 28, opposes the action upon the air valve 28 of the depression that is established in the chamber 18 of the air supply passage and urges the air valve 28 towards the valve seat 29 to reduce the effective area of the aperture 23 and effect an increase in the depression within that chamber 18. The ratio of fuel to air that is drawn through the orifice 25 that is associated with the plug valve 24 is increased by the combined effects of the reduction in the effective area of the aperture 23 and the increase in the depression within the chamber 18. The force that is imparted by the plunger 33 to the air valve 28 to urge that air valve 28 towards the valve seat 29 comprises the difference between the loading of the coil spring 41 and the force on the plunger 33 due to engine suction. The cross-sectional area of the larger-diameter plunger portion 34, the effective area of the air valve 28 which is exposed to the depression that is established in the chamber 18 of the air supply passage and the loading of the coil springs 41 and 42 that act upon the air valve 28 and the plunger 33 are selected so that the depression within the chamber 18 in the air supply passage is a function of the inverse of the depression that exists in the inlet manifold 10 when the engine is running and the air valve 28 and the plunger 33 move together as one initially and for as long as the depression in the inlet manifold 10 is adequate for such a depression to be maintained in the chamber 18 of the air supply passage.

The depression in the induction passage 11 falls to a negligible level when the driver operable throttle valve 14 is opened fully to accelerate the vehicle. Hence the suction force exerted upon the plug valve 24 is reduced to a force which is less than the opposing force that is exerted by the respective coil spring 55 so that the plug valve 24 and the fuel metering needle 52 are moved to increase the effective areas of the orifices 25 and 48 with which they are associated. Such movement of the plug valve 24 and the fuel metering needle 52 is limited by engagement of the outer limb 65 of the cranked arm with the first peg 58. Hence the increase in the quantity of the air/fuel mixture required by the engine for acceleration and the increase in the proportion of fuel to air in that mixture are achieved initially by the automatic operation of the cold start device 15 so that any tendency for the engine to stall because insufficient fuel is supplied to it is countered initially by such operation of the cold start device 15. However, providing the driver-operable throttle valve 14 is held open for a sufficient time interval, the depression in the induction passage 11 will decay to such an extent that the corresponding increase in the depression in the chamber 18 of the air supply passage cannot be maintained so that it decays as well with a consequent reduction in the quantity of fuel that is drawn into the air supply passage from the fuel passage. However the depression that acts in the other chamber 68 of the fuel pump 66 also will have fallen to a negligible level so that the coil spring 84 in that chamber 68 urges the diaphragm 71 to reduce the volume of the fuel chamber 69 and displace fuel from that fuel chamber 69 through the outlet 74 to the chamber 18 of the air supply passage. That fuel supply will be sufficient for the engine to continue running for the remainder of the transient acceleration conditions that prevail and until the engine attains steady state running conditions when its air/fuel requirements can be met by normal operation of the carburetter 12 and the cold start device 15. The manifold depression that will act upon the diaphragm 71 of the fuel pump 66 when such steady state conditions are established will withdraw the diaphraghm 71 against the action of the coil spring 84 until the projecting small diameter portion of the plunger 89 abuts the grub screw 90 which acts as a movable stop which is located in relation to the temperature of the engine. Hence the quantity of fuel that is drawn into the fuel chamber 69 when such steady state conditions are re-established diminishes as the temperature of the engine increases with a consequent reduction in the amount of fuel available to be pumped into the chamber of the air supply passage if the driver-operable throttle valve 14 is opened fully to accelerate the engine again before it has reached its normal working temperature.

The depression that is established in the chamber 18 of the air supply passage under engine idling conditions decreases with the reduction in the effective area of the orifice 25 with which the automatically-operable throttle valve 24 is associated and the consequent reduction in the mass flow of air through the air supply passage that accompanies increase in the temperature of the engine. Eventually that depression is insufficient to displace the air valve 28 sufficiently far from its seat for it to be struck by the adjacent end of the plunger 33 when the driver-operable throttle valve 14 is opened to increase the speed of the engine because the plunger 33 will abut the radially-inwardly directed flange 38 before it reaches the air valve 28. Hence, once the temperature of the engine has reached a predetermined level, the depression in the chamber 18 of the air supply passage cannot be increased above that which is established by the action upon the air valve 28 of that depression and the coil spring 42 that acts directly upon the air valve 28.

Figure 4:
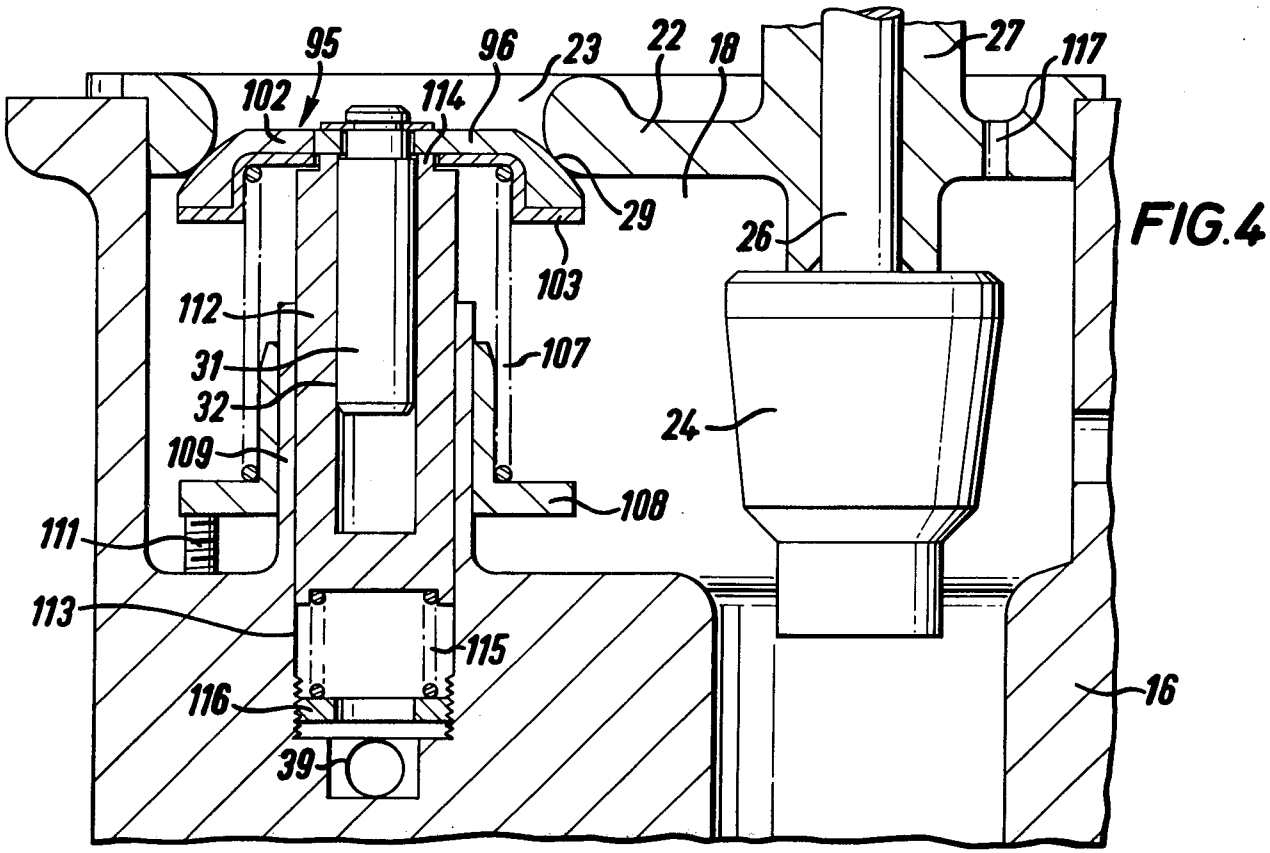
FIG. 4 is a fragmentary section which is similar to part of FIG. 3 and which illustrates a modification of a detail of the cold start fuel/air mixture supply device shown in FIGS. 1 to 3.
Figure 5:
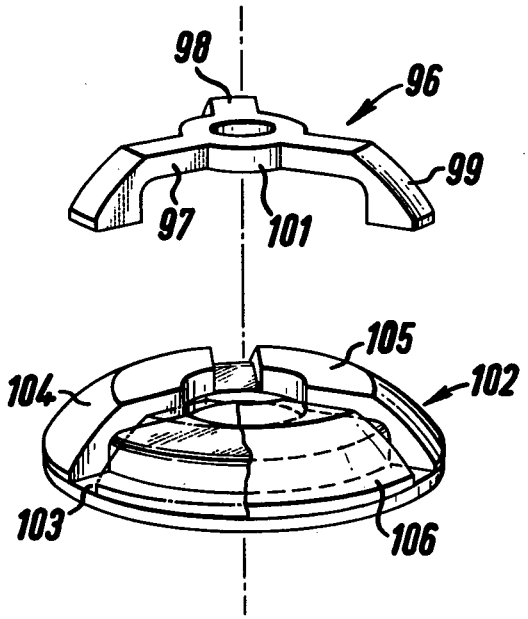
FIG. 5 is an exploded isometric view of the composite air valve of the cold start fuel/air mixture supply device shown in FIG. 4.

FIGS. 4 and 5 illustrate a modified form of air valve and plunger assembly for use in place of the air valve 28 and the plunger 33 of the cold start fuel/air mixture device 15 that has been described above with reference to FIGS. 2 and 3 of the accompanying drawings. The modified air valve and plunger assembly that is illustrated in FIGS. 4 and 5 incorporates another form of stop means for limiting movement of the plunger in the direction in which it is urged by the second yieldable biasing means which avoids use of features of the arrangement that has been described above with reference to FIGS. 2 and 3 which have presented manufacturing difficulties. The following description of the modified form of cold start fuel/air mixture supply device that is illustrated in FIGS. 4 and 5 will be restricted to those details that differe from corresponding parts of the cold start fuel/air supply device 15 that has been described above with reference to FIGS. 1 to 3. Parts of the cold start fuel/air mixture supply device that are shown in FIGS. 4 and 5 which are similar to corresponding parts of the device 15 shown in FIGS. 1 to 3 are identified in FIGS. 4 and 5 by the same reference characters.

The air valve 95 is a composite air valve which is formed of two relatively movable parts which are shown separated in FIG. 5. One of the valve parts is a three armed spider 96, each of the three arms 97, 98, 99 projecting radially outwardly from a central ring portion 101 and being equi-angularly spaced from the other two arms. The other valve part 102 is an annular disc which comprises a top-hat section component 103 of sheet material and three arcuate blocks 104, 105 and 106. A coil spring 107 functions as the first yieldable biasing means and reacts against the flange of a flanged tubular abutment member 108 which is mounted slidably upon a tubular projection 109 which projects from the body 16 into the chamber 18. The abutment member 108 is located by abutment with the end of an adjuster screw 111 which is screwed into the body 16. The end turn of the coil spring 107 that is remote from the tubular abutment member 109 is received within the annular shoulder that is formed by the top-hat section component 103 on one of its sides between its cylindrical wall portion and the radially inwardly directed annular flange portion and the three blocks 104, 105 and 106 are carried by that component 103 on the other side so that they each extend between its radially inner and outer peripheral edges and are bonded to the surfaces of the two radially-directed flange portions and the cylindrical wall portion that extends between them. The three blocks 104, 105 and 106 are equi-angularly spaced from one another so as to form radial slots between them, the width of each slot being substantially equal to the width of each arm 97, 98, 99 of the spider 96. Also the radius of the radially inner peripheral edge of the component 103 is substantially equal to the radius of the radially outer peripheral edge of the central ring portion 101 of the spider 96. The cross-section of each block 104, 105, 106 in a diametral plane of the annular disc 102 is substantially the same as the cross-section of each of the arms 97, 98 and 99 of the spider 96 in a diametral plane of that spider 96 Hence the annular disc 102 can receive the spider 96, each arm 97, 98, 99 within a respective one of the radial slots and the central ring portion 101 within the central aperture of the annular disc 102, so that the spider 96 rests upon the component 103 and, together with the annular disc 102, forms the composite air valve 95.

The guide stem 31 is coupled to the spider 96 and slides within a closed ended bore 32 formed in a plunger 112 which in turn is a sliding fit within a blind bore 113 which is formed in the body 16 and of which the bore of the tubular projection 109 forms a part. The plunger 112 has, for a major part of its overall length, an outside diameter which is greater than the diameter of the outer peripheral surface of the central ring portion 101 of the spider 96 and has a reduced diameter portion 114 at its end nearer to the spider 96, the outside diameter of the reduced diameter end portion 115 being less than the diameter of the outer peripheral surface of the central ring portion 101 of the spider 96. A coil spring 115, which urges the plunger 112 towards the air valve 95 and thereby functions as the second yieldable biassing means, reacts against an annular nut 116 which is screwed into a tapped portion of the blind bore 113.

When the engine is cold and not running, the first coil spring 107 holds the annular disc 102 with its three arcuate blocks 104, 105 and 106 seated on the valve seat 29 and the second coil spring 115 urges the reduced diameter end portion 114 of the plunger 112 into abutment with the central ring portion 101 of the spider 96 and thus acts through the plunger 112 and the spider 96 to hold the cuter ends of the arms 97, 98 and 99 seated on the valve seat 29. It is immaterial whether or not the spider 96 is a fluid tight fit within the slots and central aperture of the annular disc 102 because any paths through which air can be drawn between the spider 96 and the annular disc 102 can, together with the hole 117, serve to allow air to enter the chamber 18 whilst the engine is being cranked so that the air requirements of the engine during cranking are met without the air valve 95 being unseated. The hole 103 may be eliminated entirely if the air flow paths formed by the composite air valve 95 are large enough.

It will be noted from FIG. 4 that there is a clearance between the component 103 and the shoulder that is formed between the main part of the plunger 112 and the reduced diameter end portion 114 of that plunger 112. Hence the spider 96 functions as stop means which limit movement of the plunger 112 in the direction in which it is urged by the second coil spring 115 whilst allowing limited movement of the remainder of the composite air valve 95, namely the annular disc 102, relative to the valve seat 29 in response to any tendency for the depression in the chamber 18 to vary so as to modulate air flow into the chamber 18 as has been described above with reference to FIGS. 1 to 3, once the temperature of the engine has warmed up to a predetermined temperature below the normal operating temperature. It will be recognised that the spider 96 and the annular disc 102 function together as a single air valve, like the air valve 28 of the cold start fuel/air mixture supply device 15 that has been described above with reference to FIGS. 1 to 3, whenever the depression between the plunger 112 and the closed end of the bore 113 is sufficient to separate the plunger 112 from the spider 96.

A cold start fuel/air mixture supply device which is similar to the device 15 described above, except that it does not include the fuel pump 66 and the lever 94, has been used in an I.C. engine air/fuel induction system which also includes an air valve carburetter. The spring loaded plunger 34 served to counter a tendency for the depression in the chamber 18 to fall when the driver-operable throttle valve of the air valve carburetter was opened fully to accelerate the engine and, at least in most installations, the air/fuel requirements of the engine were not met satisfactorily when the driver operable throttle valve was opened fully to accelerate the engine.

It was thought that the plunger 34 would be held spaced from the air valve 28 by the depression that acts on it in the blind bore 37 when the engine was idling but it has been found that at very low tempratures (say — 30 degrees C.) that depression was not sufficient to compress the spring 41 which needs to be provided for other reasons.

This problem could be overcome by use of a modified form of the device 15 and associated fuel pump 66 described above in such an internal combustion engine air/fuel induction system which includes an air valve carburetter, the modification comprising removal of the plunger 33, the coil spring 41 and the flange 38 and reduction of the diameter of the blind bore 37 so that the guide stem 31 is a sliding fit in it.

I claim:

1. The combination of a cold start fuel/air mixture supply device and a fuel pump for incorporation in an internal combustion engine fuel induction system which includes a carburetter having a driver-operable throttle valve as well, the cold start fuel/air mixture supply device comprising an air supply passage which has one end for connection to the inlet manifold of the internal combustion engine so that air can be drawn through that passage by engine suction when the device is fitted to the engine, an automatically operable throttle valve in the air supply passage, the automatically operable throttle valve being adapted to co-operate with an orifice which is formed within the air supply passage in order to throttle fluid flow through that orifice and being arranged to be urged to reduce the effective area of the orifice by engine suction when the device is fitted to the engine and the engine is running under its own power, a fuel passage which terminates in a fuel discharge nozzle which is formed in the air supply passage upstream of the orifice, the fuel passage including fuel metering means for metering flow of fuel drawn through the fuel passage from a source of liquid fuel by a depression which is established within part of the air supply passage upstream of the orifice, and thermostatically-controlled means which are adapted to be responsive to the temperature of the engine to which the cold start fuel/air mixture device is fitted when used and which are operable to limit movement of the automatically operable throttle valve to reduce the effective area of the orifice as the temperature of the engine to which the device is fitted in use increases so that when the device is fitted to the engine and the engine has started to run under its own power, both the air flow in the air supply passage and the flow of fuel into the air supply passage through the fuel passage are decreased progressively with increase in engine temperature; and the fuel pump being adapted to draw liquid fuel from a source of liquid fuel and to pump that liquid fuel into the air/fuel induction system when the driver-operable throttle valve is opened so that the depression in the induction system downstream of the driver operable throttle valve decreases, the thermostatically-controlled means also being operable to modulate the performance of the fuel pump so that the amount of fuel that can be pumped into the induction system by the fuel pump when the combination is in use when the engine has started to run under its own power and when the driver-operable throttle valve is opened is reduced progressively with increase in engine temperature.

2. The combination according to claim 1 wherein the theromstatically controlled means comprise a movable stop for limiting movement of the automatically operable throttle valve in the direction in which it is moved to reduce the effective area of the orifice, the position of the stop being controlled automatically in relation to the temperature of the engine by control means which are responsive to the temperature of the engine when the device is in use so that it is moved to allow following movement of the automatically operable throttle valve in said direction as the engine warms up towards normal operating temperature whereat movement of said automatically operable throttle valve to close the orifice is permitted.

3. The combination according to claim 1 wherein the cold start fuel/air mixture supply device includes an air valve which co-operates with a valve seat to vary the area of part of the air supply passage upstream of the orifice and thereby controls the depression that is established within that portion of the air supply passage between the orifice and the valve seat, which is the portion of the air supply passage in which the fuel discharge nozzle is formed, and that serves as the fuel demand signal that draws fuel into the passage from the source of liquid fuel, and yieldable biassing means for urging the air valve towards the valve seat against the action upon the air valve of any such depression which is established within the air supply passage between the valve seat and the orifice and which tends to unseat the air valve.

4. The combination according to claim 3 wherein means are provided for reducing the biasing effect of said yieldable biasing means for certain comditions of operation of the engine to which the cold start fuel/air mixture supply device is fitted in use.

5. The combination according to claim 4, wherein the fuel pump includes a fuel chamber which has a movable wall which is adapted to be subjected to a depression which is related to the depression in the inlet manifold of the engine when the combination is in use and which is arranged to be moved to enlarge the volume of the fuel chamber and to draw liquid fuel into that chamber by an increase in that depression and to be moved in the opposite direction in response to a reduction in that depression that accompanies opening of the driver-operable throttle valve so that the volume of the fuel chamber is reduced and liquid fuel is displaced from the fuel chamber through an outlet of the fuel chamber into the air/fuel induction system.

6. The combination according to claim 1 wherein the fuel pump is adapted to be rendered inoperative to pump liquid fuel into the air/fuel induction system when the engine with which the combination is used has warmed up to the temperature at which the cold start fuel/air supply device ceases to supply extra fuel and air to the engine.

7. An internal combustion engine having an air/fuel induction system comprising an inlet manifold; a fixed choke carburetor which comprises an induction passage which is connected to the inlet manifold, there bing a venturi throat of fixed dimensions formed in the induction passage and a drive-operable throttle valve mounted in the induction passage downstream of the throat; a cold start fuel/air mixture supply device comprising an auxiliary air supply passage which is connected to the induction passage of the carburetter downstream of the driver-operable throttle valve an automatically-operable throttle valve in the auxiliary air supply passage, the automatically-operable throttle valve being adapted to cooperate with an orifice which is formed within the auxiliary air supply passage in order to throttle fluid flow through that orifice and being arranged to be urged to reduce the effective area of the orifice by suction generted in the inlet manifold of the engine when the engine is running under its own power, a fuel passage which terminates in a fuel discharge nozzle which is formed in the auxiliary air supply passage upstream of the orifice, the fuel passage including fuel metering means for metering flow of fuel drawn through the fuel passage from a source of liquid fuel by a depression which is established within the air supply passage upstream of the orifice when the engine is cranked for starting and when the engine is running under its own power whilst the orifice is open; and thermostatically-cntrolled means which are responsive to the temperature of the engine and which are operable in response to the temperature of the engine to limit movement of the automatically-operable throttle valve to reduce the effective area of the orifice so that, once the engine has started to run under its power, both the air flow in the auxiliary air supply passage and the flow of fuel into the auxiliary air supply passage through the fuel passage are decreased progressively with increase in engine temperature; wherein there is provided a fuel pump which is adapted to draw liquid fuel from a source of liquid fuel and to pump that liquid fuel into the air/fuel induction system when the driver-operable throttle valve is opened so that the depression in the induction system downstream of the engine decreases, the fuel pump and the thermostatically-controlled means being interconnected such that the performance of the fuel pump is modulated by the thermostatically-controlled means, so that, once the engine has started to run under its own power, the amount of fuel that can be pumped into the induction system by the fuel pump when the driver-operable throttle valve is opened is reduced progressively with increase in engine temperature.

8. An internal combustion engine according to claim 7 wherein the cold start fuel/air mixture supply device includes an air valve upstream of the automatically-operable throttle valve, the air valve co-operating with an associated valve seat to vary the area of part of the auxiliary air supply passage upstream of the orifice and thereby to control the depression that is established within that part of the auxiliary air supply passage between the valve seat and the orifice, which is the part of the passage in which the fuel discharge nozzle is formed, and that serves as the fuel demand signal that draws fuel into the passage from the source of liquid fuel, and yieldable biassing means for urging the air valve towards the valve seat against the action upon the air valve of any such depression which is established within the air supply passage between the valve seat and the orifice and which tends to separate the air valve from the valve seat.

9. An internal combustion engine according to claim 7 wherein the fuel pump includes a fuel chamber which has a movable wall which is subjected to a depression related to the depression in the induction passage of the carburetter and which is arranged to be moved to enlarge the volume of the fuel chamber and to draw liquid fuel into that chamber by an increase in the depression in the induction passage and to be moved in the opposite direction, in response to a reduction in the depression in the induction passage that accompaines opening of the driver operable throttle valve so that the volume of the fuel chamber is reduced and liquid fuel is displaced from the fuel chamber through an outlet of the fuel chamger into the auxiliary air supply passage of the cold start fuel/air mixture supply device.

* * * * *